US005901518A

United States Patent [19]

Harkins

[11] Patent Number: 5,901,518

[45] Date of Patent: May 11, 1999

[54] BUILDING INSULATION SYSTEM WITH FALL PROTECTION

[76] Inventor: Daniel J. Harkins, P.O. Box 324, Stoughton, Wis. 53589

[21] Appl. No.: 08/673,076

[22] Filed: Jul. 1, 1996

[51] Int. Cl.[6] ..... E04B 1/62; E04B 7/00

[52] U.S. Cl. ..... 52/404.3; 52/407.3; 52/407.4; 52/650.3; 52/745.06; 52/DIG. 12

[58] Field of Search ..... 52/407.1, 407.2, 52/407.3, 407.4, 404.5, 404.3, 650.3, 741.3, 741.4, 742.12, 745.06, 746.11, 749.12, DIG. 12

[56] References Cited

U.S. PATENT DOCUMENTS

| | | | |
|---|---|---|---|
| 3,969,863 | 7/1976 | Alderman | 52/407.4 |
| 4,047,345 | 9/1977 | Alderman | 52/407.4 |
| 4,233,791 | 11/1980 | Kuhl et al. | 52/404.3 X |
| 4,303,713 | 12/1981 | Clemensen et al. | 52/746.11 X |
| 4,441,294 | 4/1984 | Riley | 52/404.3 |
| 4,446,664 | 5/1984 | Harkins | 52/404.3 |
| 4,566,239 | 1/1986 | Smigel et al. | 52/407.4 |
| 4,573,298 | 3/1986 | Harkins | 52/404.3 |
| 4,635,423 | 1/1987 | Ward | 52/404.3 X |
| 4,875,320 | 10/1989 | Sparkes | 52/406.1 |
| 5,406,764 | 4/1995 | Van Auken et al. | 52/745.06 X |

FOREIGN PATENT DOCUMENTS

| | | | |
|---|---|---|---|
| 552923 | 2/1958 | Canada | 52/695 |
| 2044330 | 10/1980 | United Kingdom | 52/713 |

*Primary Examiner*—Carl D. Friedman
*Assistant Examiner*—Laura A. Callo
*Attorney, Agent, or Firm*—Zarley, McKee, Thomte Voorhees & Sease; Dennis L. Thomte

[57] ABSTRACT

A system for thermally insulating a building roof structure and providing fall protection includes a gridwork of longitudinal and transverse high strength tensioned bands which co-act with a suspension sheet which is sealed along its edges and fastened at multiple locations to the building structure for both supporting insulation material thereon and providing an alternate means of fall protection.

18 Claims, 5 Drawing Sheets

BUILDING INSULATION SYSTEM WITH FALL PROTECTION

BACKGROUND OF THE INVENTION

1. Technical Field

The present invention is directed generally to a building insulation system wherein the platform of crossing support bands and a suspension sheet material is of sufficient strength to support a man's weight, thereby affording an alternate means of fall protection for accidental falls by an installer of the building insulation system.

2. Description of the Prior Art

A system for insulating the roof of new and existing buildings utilizing a gridwork of tensioned support bands underlying a suspension sheet material which supports insulation thereon is disclosed in my U.S. Pat. No. 4,446,664 and 4,573,298.

New OSHA (Occupational Safety and Health Administration) fall protection standards which affect steel erectors, insulators and sheeters where promulgated in October of 1995.

With pre-engineered building systems now the predominant method of non-residential lowrise construction for buildings, the more restrictive fall protection standards will have a great impact on the contractors involved. One solution is to purchase heavy and expensive safety nets in order to provide the leading edge protection against falls. The costs of this equipment, the maintenance of it, the expense of putting it in place, taking it down, moving, storing it, etc. can result in a substantial increase in the per square foot cost of the roof insulation system being installed. In many rural areas, contractors and erectors have virtually ignored safety requirements or considered them too restrictive and impractical to use. With expanded enforcement efforts by OSHA, few contractors will risk violation of the new fall protection standards.

Accordingly, a primary object of the present invention is to provide a building insulation system which doubles as an alternate means of fall protection.

A related object of the invention is to provide a building insulation system wherein installers equipped with such safety devices as a full body harness with shock absorbing lanyards are afforded the added protection of an insulation suspension platform of a strength to support a man's weight in the event of an accidental fall by an installer or inspector while insulating and roofing.

Another object is to provide such a building insulation system wherein each end of each support band of the suspension sheet gridwork is secured to the structure by fail-safe, dual fasteners.

Another object is to provide such a building insulation system wherein the suspension sheet is formed of a fabric with increased weaves per inch to effect a strength sufficient to support a man's weight.

Another object of the invention is to provide a building insulation system wherein the support bands and fasteners are constructed of a size and material to be of sufficient strength to support a man's weight on the installed system.

Finally, an object of the invention is to provide a building insulation system which affords efficient thermal insulation while doubling as an effective alternate means of fall protection.

SUMMARY OF THE INVENTION

A system for thermally insulating a building roof structure and providing an alternate means of fall protection includes a gridwork of longitudinal and transverse high strength tensioned bands which co-act with a suspension sheet which is sealed along its edges and fastened at multiple locations to the building structure for both supporting insulation material thereon and providing an alternate means of fall protection.

Each longitudinal support band is connected at each of its ends to a respective building rafter by a pair of spaced apart fasteners for a fail safe connection. The fasteners are preferably spaced apart by at least two inches, with the outer fastener preferably spaced about four inches from the adjacent end of the longitudinal support band. The transverse support bands likewise have both opposite ends connected to an eave strut by another dual fastener fail safe connection with the outer fastener preferably spaced a minimum of four inches from the free end of the transverse support band. Those inner and outer fasteners should likewise be spaced apart by a minimum of two inches.

The fasteners are preferably headed Tek self-drilling fasteners equipped with washers for relatively wide area contact with the suspension sheet. Likewise, the suspension sheet itself is preferably a strong fabric having approximately twelve by twelve weaves per inch, or the equivalent, for sufficient strength to support a man's weight on the suspension sheet. The support bands themselves are constructed of heavier strapping such as steel strapping of one and one quarter inches wide, and 0.025 inches thick.

Thermal insulation is arranged on the suspension sheet to substantially fill the spaces between the purlins and eave struts.

The invention is further directed to the method of installing the system for thermally insulating a roof structure with fall protection. The method includes the fail safe dual fastener securement straps for anchoring each end of the various longitudinal and transverse support bands of the band grid work as well as using fasteners, support bands and a suspension sheet which are of sufficient strength for supporting a man's weight on the installed system. A longitudinal strap tensioning and installation method includes first fastening one end with dual fasteners and then pulling the strap tight to mark hole locations in the opposite end of the strap, and punching those holes. Upon pulling the strap tight again, one hole location is marked on the rafter after which a hole is pre-drilled in the rafter approximately one half inch outwardly beyond the mark. A second hole is pre-drilled at the selected spacing inwardly of the first pre-drilled hole. A fastener is then inserted completely through the outer hole of the longitudinal strap and is angled to press its tip into the outer pre-drilled hole in the rafter. As the fastener is screwed in, it both secures and tensions the strap whereupon a second fastener can be directed through the other hole drilling it straight into the rafter.

DESCRIPTION OF THE PREFERRED EMBODIMENTS

Figure 1:
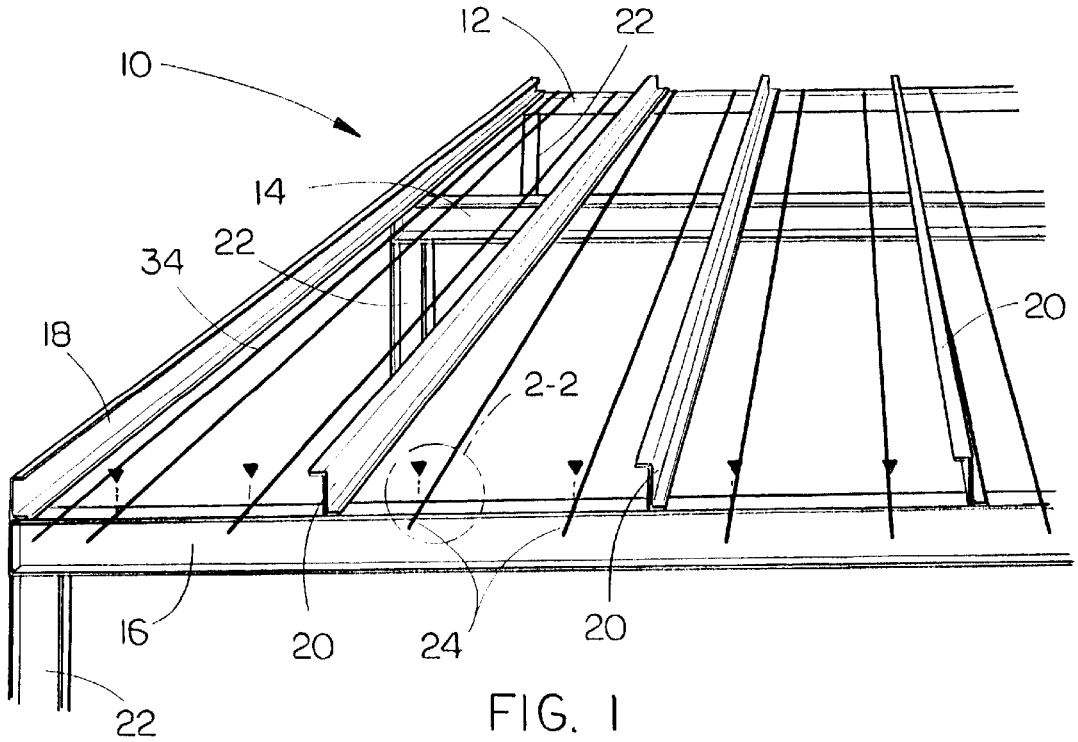
FIG. 1 is a partial perspective view of a building roof structure on which the thermal insulation system of the invention may be installed.
Figure 2:
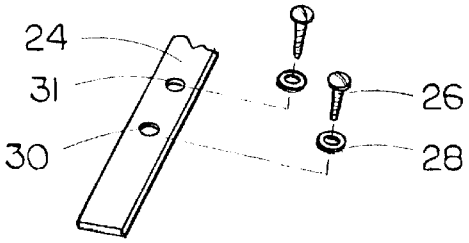
FIG. 2 is an enlarged perspective view of one end of a longitudinal support band.

FIG. 1 illustrates a typical building roof system on which the thermal insulation and fall protection system of the present invention may be installed. Building roof structure 10 is illustrated as representative of the many types of building roof structures for which this type of thermal insulation system is applicable, as more fully described in my U.S. Pat. No. 4,446,664 and U.S. Pat. No. 4,573,298.

Building roof structure 10 includes a far end rafter 12, an intermediate rafter 14 and a near end rafter 16. An eave strut 18 is extended between and connected to the ends of the rafters and a plurality of purlins 20 likewise interconnect the rafters in parallel relation to the eave strut 18. The rafters are supported above the ground on columns 22.

Installation begins with setting up the support band dispenser and the cutting of longitudinal support bands 24. They are cut the full length of the building from far end rafter 12 to near end rafter 16 plus about two additional feet. The longitudinal support bands are then pulled over the rafters from one end of the building to the other, preferably pulling four or more straps on each pass. Usually two longitudinal support bands 24 are arranged between each pair of purlins, a maximum of thirty inches on center. All of the longitudinal support bands 24 are pulled into place over the rafters with the finished side down and with the bands hooked on the far end rafter 12. Once a number of the longitudinal support bands 24 are pulled into position, one crewman fastens the far end of each strap 24 with two TEK 4, self-drilling fasteners 26 with washers 28 to the top of the far end rafter 12. Holes must be prepunched in the longitudinal support band 24 for the fasteners 26.

The other ends of all of the fastened longitudinal support bands 24 are hooked on the near end rafter 16. The straps are fastened in tension with two self-drilling screws 26 with washers 28 as follows. First, the longitudinal support band 24 is pulled tight and the hole locations are marked on the band a minimum of two inches apart. The marked holes are then punched in the band 24. Secondly, the strap is then again pulled tight and one hole location is marked on the rafter in registration with the outer strap hole 30. A hole is then pre-drilled in the rafter 16 approximately one half inch outwardly of the marked hole. A corresponding inner hole may be pre-drilled in the rafter approximately two inches inwardly of the outer hole to register with the strap holes 30 and 31. Next, a fastener 26 is installed completely through the outer band hole 30. The fastener tip angled for insertion into the pre-drilled outer rafter hole 32. As the fastener 26 is screwed into the outer rafter hole 32 it tensions the longitudinal support band 24. Finally, the second fastener 26 is inserted through the inner band hole 31 and drilled straight into the rafter.

The additional eave line strap 34 shown in FIG. 1 is positioned even with the inside of wall girt and is required only with wall systems.

Figure 3:
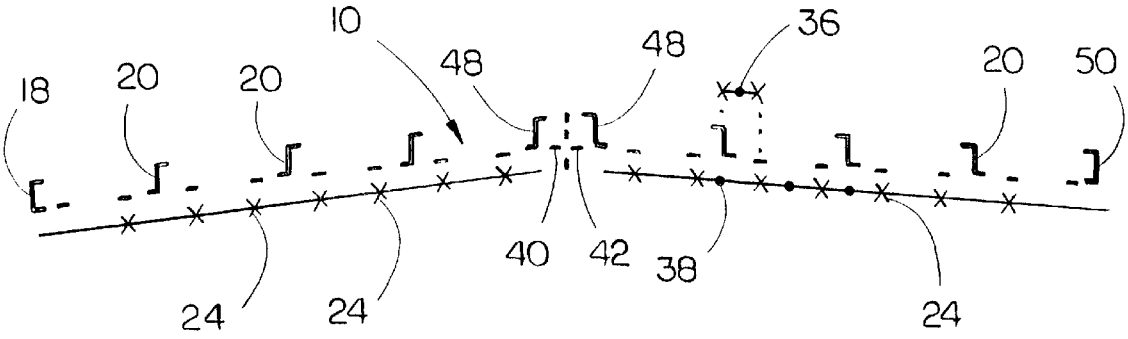
FIG. 3 is a diagrammatic end view of the building roof structure of claim 1 indicating longitudinal strap spacing relative to the purlins.

FIG. 3 illustrates a preferred arrangement and spacing of longitudinal support bands 24 relative to the purlins 20 and eave struts 18. Line 36 shows that the typical space between the purling web and a longitudinal support band 24 is equal to ¼ of the purlin spacing. Likewise, line 38 indicates that the typical space between longitudinal support bands 24 is equal to one half of the purlin spacing. FIG. 3 shows that the longitudinal support bands 24 include two ridge bands 40 and 41.

Installation of the transverse support bands 44 is next. The strapping dispenser is again set up on the floor or ground and transverse support bands 44 are cut the width of the building plus about three feet. Roofs with two-twelve pitch, or greater, require additional band length to allow for the incline. Simply multiply the building width by the correction factor in the table below to find the proper length, then add three feet.

| Roof Pitch | Width Correction Factors |
|---|---|
| Two:twelve | 1.02 |
| 4:12 pitch | 1.06 |
| 6:12 pitch | 1.12 |
| 8:12 pitch | 1.21 |

Figure 5:
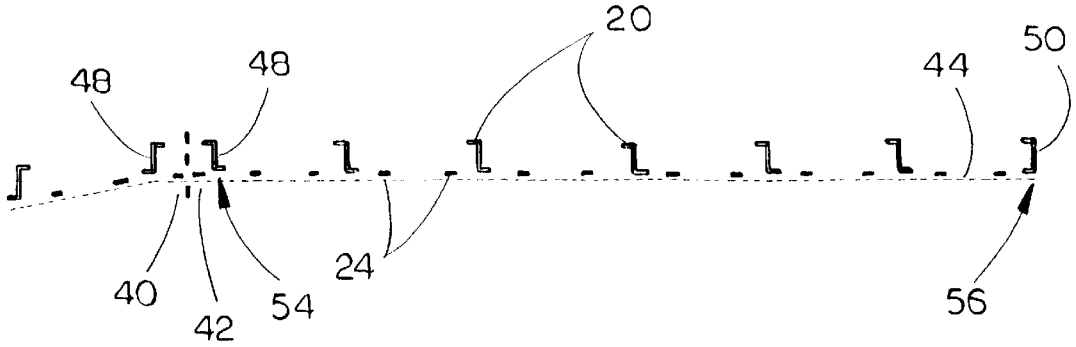
FIG. 5 is a diagrammatic end view of the building roof structure of claim 4 showing the suspension sheet position and securement.
Figure 12:
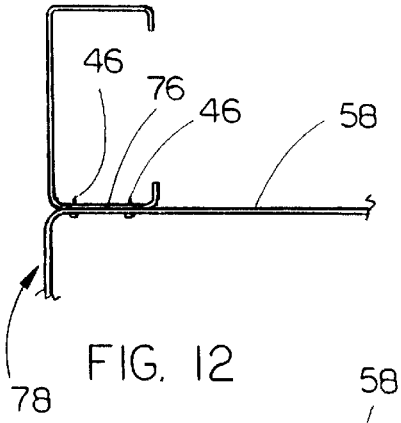
FIG. 12 is a detailed end view showing the connection of the suspension sheet to the underside of an eave strut.

The transverse support bands 44 are then pulled below the purlins 20 from one eave strut 18 of the building, over every eighth to tenth longitudinal support band 24, over both ridge bands 40 and 42, if any and under all other longitudinal support bands 24. This procedure allows for faster installation and keeps the transverse support bands in the same plane. Next, the far end of each transverse support band 44 is fastened to the bottom of eave strut 18 with two fasteners 46, as shown in FIG. 12, with a minimum of 4" of band beyond the outer fastener. In the illustrated embodiment, the transverse support band 44 is pulled tight to the ridge and fastened to one ridge purlin 48, as shown in FIG. 5, with the remaining length pulled tightly to the near eave 50 and fastened to the bottom of that eave strut 50 with two fasteners 46. Again, pre-punching of the fastener holds in the transverse support band 44 as required.

Note that roof pitches of 2:12 are greater requiring fastening at both ridge purlins 48 to allow for adequate length of transverse support band 44 to reach both ridge purlins upon subsequent fastening.

Figure 4:
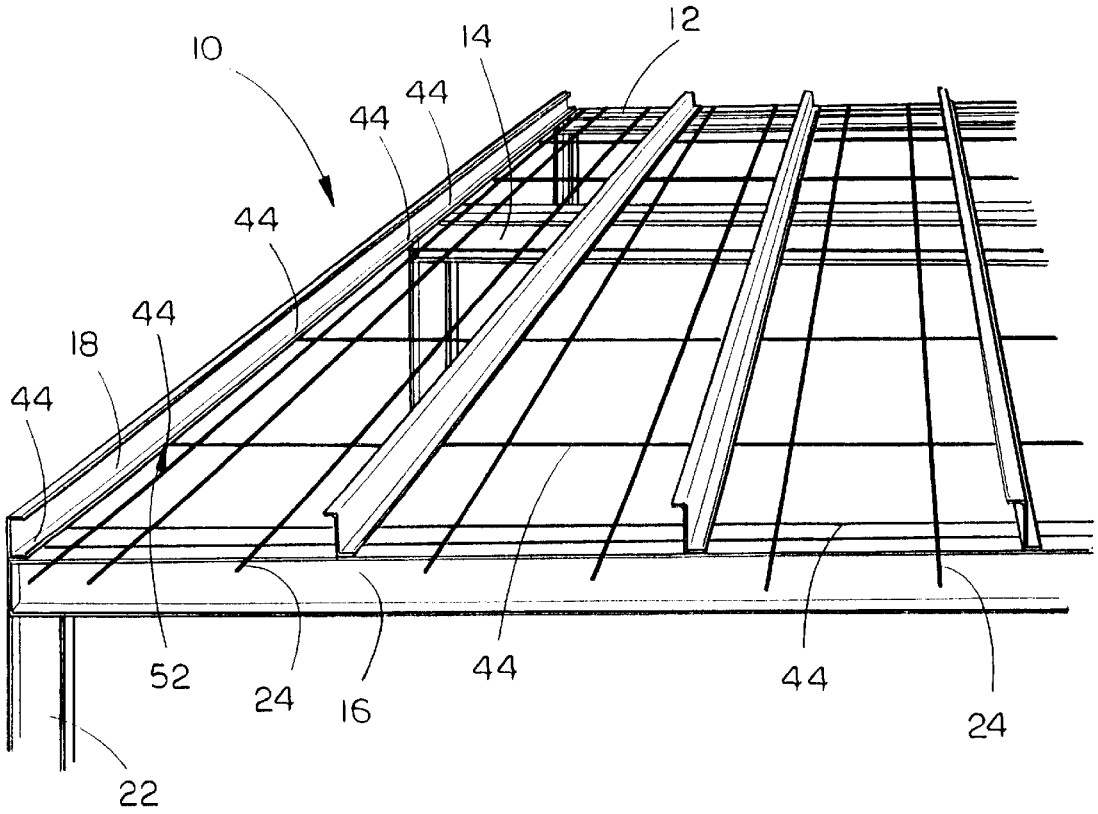
FIG. 4 is a partial perspective view of the building roof structure showing both the longitudinal and transverse support bands.

FIG. 4 illustrates that the typical transverse strap spacing is the bay length between adjacent rafters, divided by 4 or 5. FIG. 4 likewise shows the first fastening point 52 in the bottom of eave strut 18, the second fastening point 54 in the ridge purlin 48 and the third fastening points 56 in the bottom of the near eave strut 50. The transverse support bands 44 are pulled from one side of the building to the other, over every 6th to 8th longitudinal support band 24 and over both the ridge bands 40 and 42.

Figure 6:
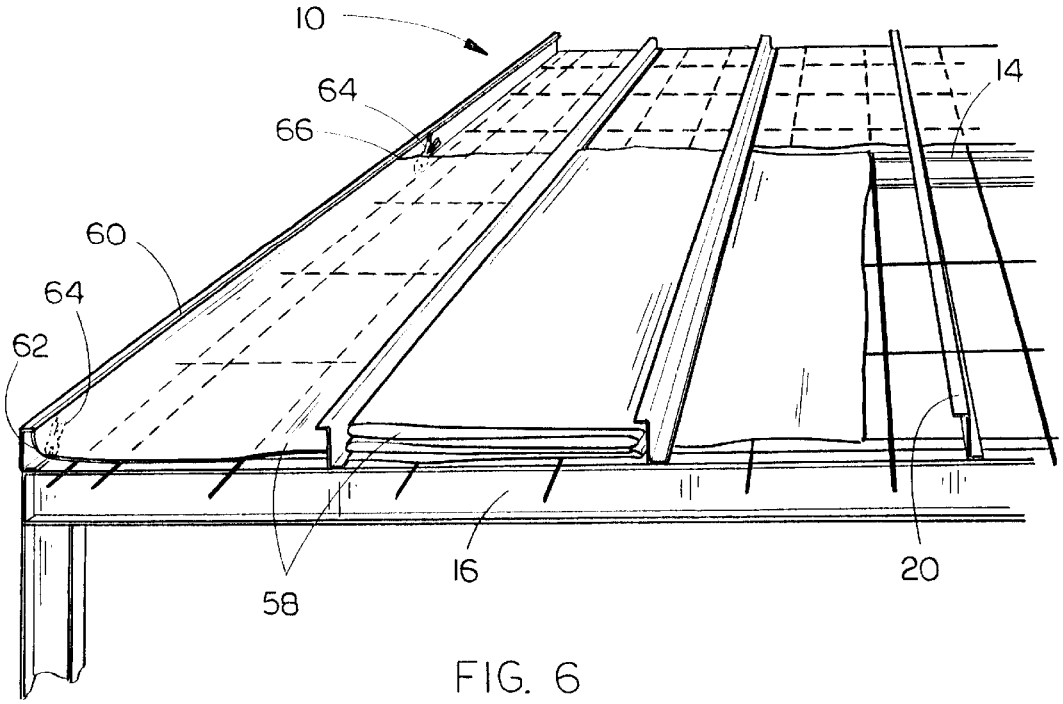
FIG. 6 is a partial perspective view of the building roof structure showing the suspension sheet being installed thereon.
Figure 7:
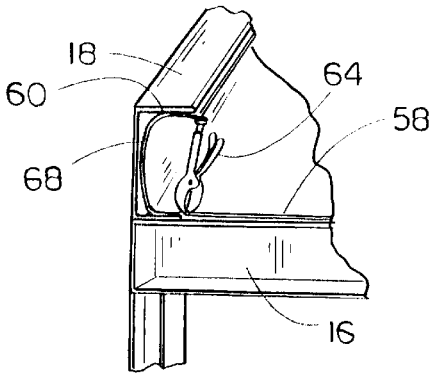
FIG. 7 is a partial perspective view showing a corner of the suspension sheet being clamped to an eave strut.

The suspension sheet 58 is generally provided in factory folded form as illustrated in FIG. 6. It is situated between any two purlins on the band grid work or platform, normally at the ridge or adjacent one eave 18. The suspension sheet may be provided with different colored surfaces so the folded sheet should be arranged with the desired color side facing downwardly. The bottom edge 60 of the suspension sheet 58 is pulled to the outside corner of 62 of eave strut 18 and approximately 8" beyond. The suspension sheet 58 is insecurely clamped to the eave strut 18 at a position above the near rafter 16 with a vise grip tool 64 as illustrated in FIG. 7. The opposite corner 66 of suspension sheet 58 is then pulled above the other rafter 14, keeping the suspension sheet tight, and it is clamped in position, likewise with about 8" of extra sheet material. It is important to keep the suspension sheets square with the eave strut 18 and centered on the bay.

Figure 8:
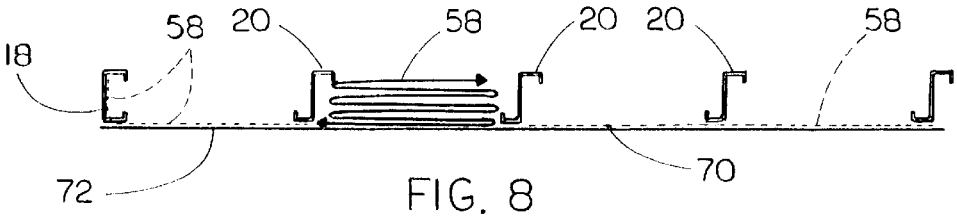
FIG. 8 is an end diagrammatic view showing the placement of the folded suspension sheet between a pair of purlins.

FIG. 7 illustrates that the suspension sheet 58 is positioned so as to extend about 1" inwardly from the edge of rafter 16 to afford a sealing edge as described below. The approximately 8" of extra fabric at the end of the suspension is illustrated at 68 in FIG. 7. FIG. 8 shows by dotted line 70 that the suspension is pulled above the platform 72 of support bands and below the purlins 20.

Figure 9:
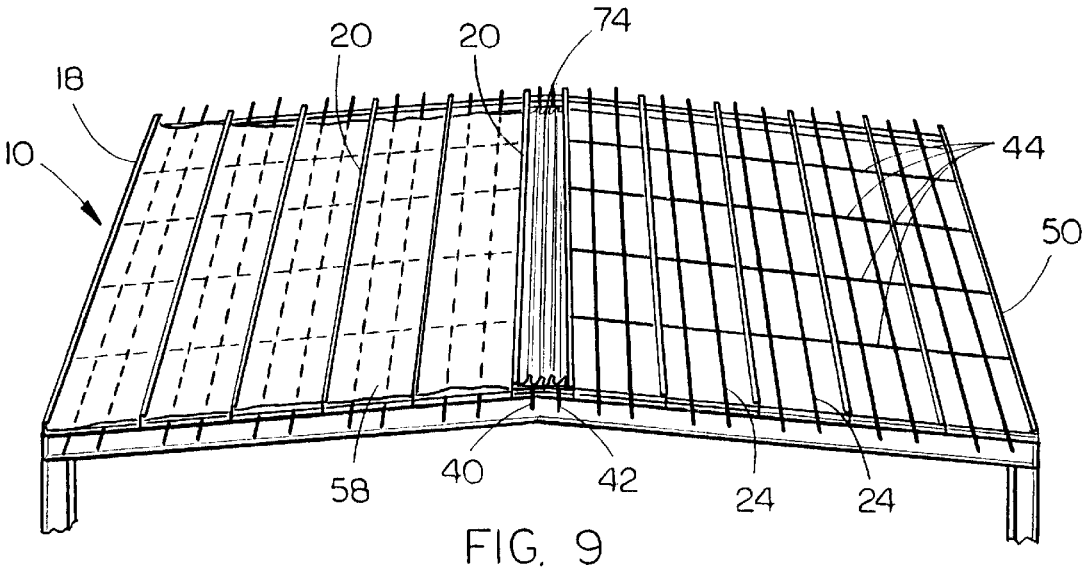
FIG. 9 is a perspective view of the building roof structure showing the securement of the suspension fabric after it is pulled into place.
Figure 10:
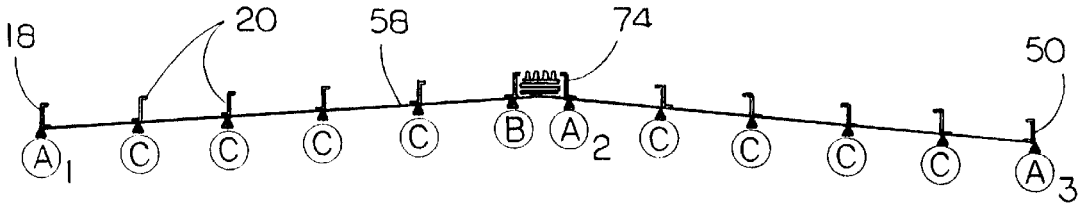
FIG. 10 is an end diagrammatic view illustrating the points of securement of the suspension sheet to the purlins and eave struts.
Figure 11:
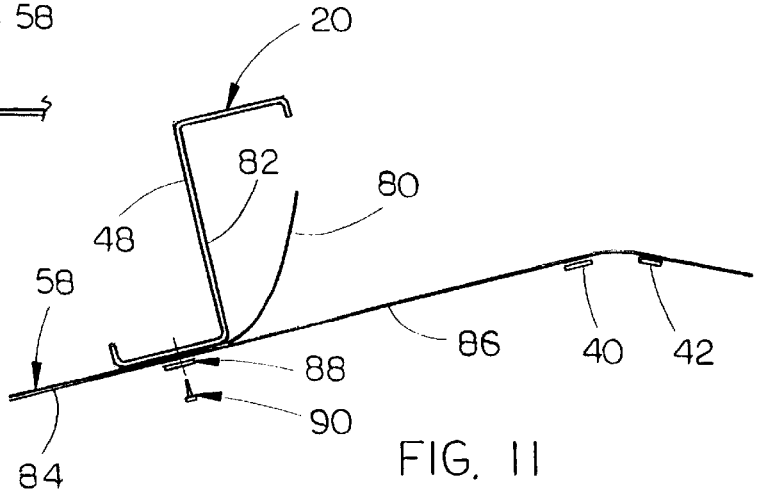
FIG. 11 is an enlarged detailed view of a splice in the suspension sheet at a purlin.

Referring to FIG. 9, the other end of the suspension sheet 58 is pulled off of the top of the folded pile to the ridge space 74 as shown in FIGS. 9 and 10. The suspension sheet 58 is pulled tight and the B fasteners are installed from below into the ridge purlin. The B fasteners are preferably TEK 2 fasteners with washers provided. The suspension sheet should be clamped tightly every 20–25" along the rafters to aid in the installation. If both sides of the roof are sheeted at the same time, remove the "A2" fasteners, which were installed when installing the bands, and pull the suspension sheet to the other eave strut and clamp it snugly in position as was done on the opposite side. If only one side of the roof is to be sheeted at a time, the suspension sheet can be left in the ridge purlin space 74. Pushing the suspension sheet 58 back under the roof sheets and/or covering the ridge space 74 will protect the suspension sheet against water entry. Separate pieces of suspension sheet for each side of the ridge are recommended if the sheeting is planned one slope at a time. A splice is made in the bottom of a ridge purlin 48 as shown in FIG. 11. The "C" fasteners, illustrated in FIG. 10, are installed where the transverse support bands 44 cross below each purlin 20. After installing the "C" fasteners near the eaves, back out the "A1" or "A3" fasteners illustrated in FIG. 10, pull the suspension sheet to the wall line and reinstall the fasteners "A1" and "A3" in the same holes. Note that for "A1" and "A3" this system requires two fasteners with washers at least four inches away from each band as indicated by arrow 76 in FIG. 12. Arrow 78 shows the minimum six inches of suspension sheet extending beyond the fastening point.

In the splice detail of FIG. 11, the end portion of the top sheet 80 is adhered to the uphill side 82 of purlin 20. That end should extend a minimum of six inches beyond the fastening point in the bottom flange of the purlin. The free end 84 of bottom sheet 86 is taped to the top sheet 80. A transverse band 88 is installed along all splices in the suspension sheet 58 and fasteners 90 on the splice are arranged a maximum of thirty inches on center of the bottom flange of the purlin.

Figure 13:
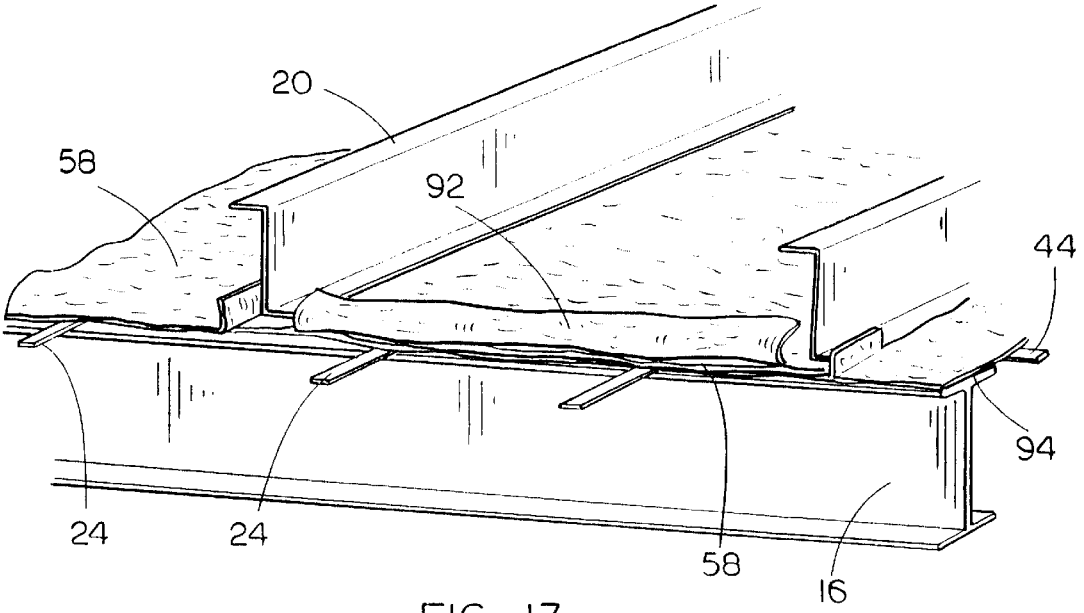
FIG. 13 is a partial perspective view showing the folding and trimming of the suspension sheet for sealing to a rafter.

Referring to FIG. 13, the edge 92 of suspension sheet 58 is folded back on top of itself and the fold is unrolled until the edge contacts the rafter flange 94. The edges of the suspension sheet should be trimmed to fit neatly around all of the purlins, as illustrated in FIG. 13. Once trimmed, the edges are neatly sealed with adhesive sealant to the top side of the rafter of flange 94 to complete the installation of the suspension sheet 58. When trimming the suspension sheet 58, care should be taken not to overcut the suspension sheet.

Figure 14:
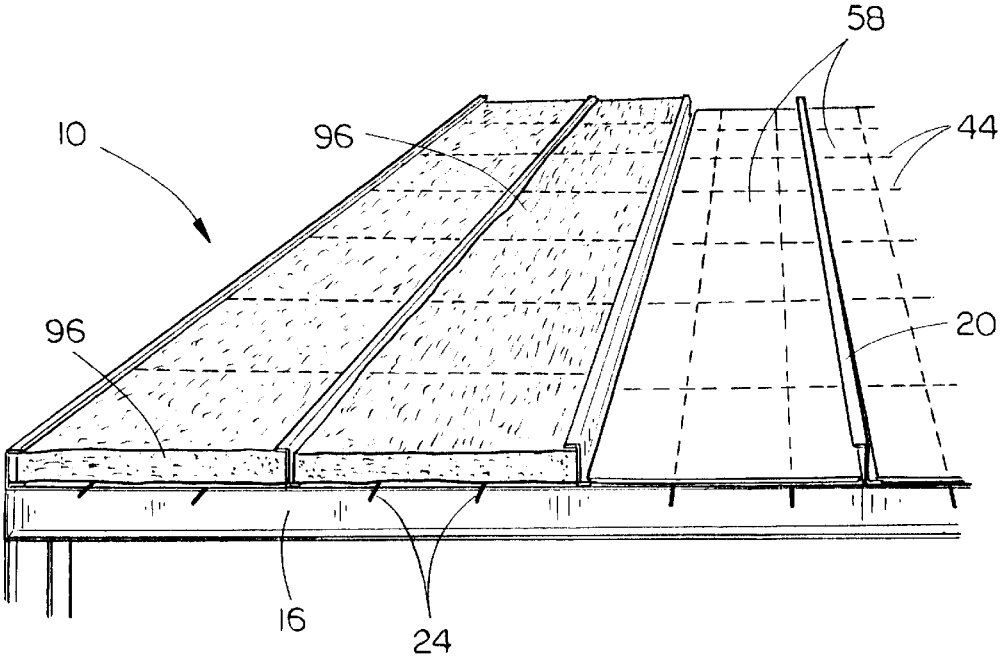
FIG. 14 is a partial perspective view of the building roof structure showing insulation placed on the suspension sheet between the purlins.

Finally, FIG. 14 shows one example of placement of insulation onto the suspension sheet 58. Unfaced insulation baths 96 are unwrapped and positioned neatly on top of the suspension sheet between the purlins 20. A second layer of insulation, not shown, can be installed on top of the purlins and first layer of insulation, or a separate thermal brake material can be used on top of the purlins as the roof panels are installed. Fiberglass, cotton or cellulose insulation with or without blanket forming resin can be installed in place of bad insulation. This can be installed during roofing or afterwards.

The basic concept of the invention may be summarized as follows:

(1) Create a platform with high strength attention to steel bands. Install two fasteners with washers in each end of the bands and one fastener with a washer at each intermediate fastening point, approximately 60" apart. Pre-punching of holes with a punch is required for the holes in the bands.

(2) Slip the suspension sheet into position on the platform, generally a bay at a time, and clamp the sheets squarely and snugly in position.

(3) Seal the edges and fasten the suspension sheet to the overlying structure with self drilling screws with a washer on the head of each screw.

(4) Position the insulation layers and thermal break as the roof is sheeted. Installation can be blown in or otherwise installed from the underside after the roof is covered as well.

Safety cables and a full body harness with shock absorbing lanyards must be used while installing the system of the invention for topside workmen. A full body harness with lanyard in combination with a suitable lift must be used by bottom-workman to install the system of the invention.

To accommodate the various types of roof structures in which the invention pertains, the term "eave strut" generally refers to the outer most secondary structural member of whatever roof structure or portion thereof is being insulated.

The system is designed to be of sufficient strength to support a man's weight, generally between 250 and 400 pounds. The system is tested by dropping a 400 lb. weight with the center of gravity of the weight 42" above the system. To pass the test, the system must stop the falling weight. In one test, 400 lb. bags of washed gravel were placed into a larger reinforced bag that would stand being dropped repeatedly. The bag measured about 21" in diameter and 15" deep. The 400 lb. bag was then hoisted above the product to a height measured 42" above the plane of the fall protection system, measuring from the center of the weight. The cord supporting the weight was then cut allowing the weight to free fall in one concentrated load. The weight was dropped several times in different parts of the assembly to test different areas. Because of the gravitational pull of the earth, objects allowed to freefall will accelerate at about 32.5 feet per second squared. It takes about 1/10th of a second for the 400 lb. weight to hit the fall protection system after the cord is cut.

Thus there has been shown and described an improved building insulation system with fall protection and method of installing the same which accomplishes all of the stated objects.

I claim:

1. In a building roof structure including a pair of rafters having opposite ends, a pair of eave struts connected to and extended between opposite end of said rafters, and a plurality of intermediate purlins extending longitudinally between said pairs of rafters, a system for thermally insulating said roof structure and providing an alternative means of fall protection for installers of the systems, including a plurality of longitudinal support bands, said longitudinal support bands each having opposite ends and being connected at each of said ends to a respective said rafter by a pair of spaced apart fasteners including inner and outer fasteners, said outer fastener being spaced at least two inches from an adjacent end of said longitudinal support band, a plurality of transverse support bands, said transverse support bands having opposite ends and being connected at each of said ends to a respective said eave strut by a pair of spaced apart fasteners including inner and outer fasteners, said outer fastener being spaced at least two inches from an adjacent end of said transverse support band, said longitudinal and transverse support bands being of sufficient strength to support at least approximately 400 pounds, an independent suspension sheet supported on said longitudinal and transverse support bands, said suspension sheet being longer than the distance between said rafters so as to extend beyond each rafter and being wider than the distance between said eave struts so as to overlap said eave struts, said suspension sheet being of sufficient strength to support at least approximately 400 pounds, a plurality of band fasteners connecting said transverse bands to the underside of said purlins with said suspension sheet interposed between said bands and purlins, and thermal insulation on said suspension sheet and substantially filling the space between said purlins and eave struts.

2. The system of thermally insulating a roof structure of claim 1 wherein said outer fastener for said longitudinal support band is spaced at least three inches from the adjacent end of the longitudinal support band.

3. The system for thermally insulating a roof structure with fall protection of claim 2 wherein said outer fasteners of said longitudinal support bands are spaced about four inches from the adjacent end of said longitudinal support band.

4. The system for thermally insulating a roof structure with fall protection of claim 3 wherein the spacing between said pair of fasteners for said longitudinal support bands is at least two inches.

5. The system for thermally insulating a roof structure with fall protection of claim 4 wherein said fasteners for said longitudinal support bands each comprise a headed fastener and a washer.

6. The system for thermally insulating a roof structure with fall protection of claim 5 wherein said fasteners for said longitudinal support bands are self-drilling self-tapping fasteners with washers.

7. The system for thermally insulating a roof structure of fall protection of claim 1 wherein said longitudinal and transverse support bands are formed of metal.

8. The system for thermally insulating a roof structure with fall protection of claim 1 wherein said suspension sheet is formed of fabric.

9. The system for thermally insulating a roof structure of fall protection of claim 8 wherein said fabric has at least 12×12 weaves per inch.

10. The system for thermally insulating a roof structure with fall protection of claim 1 further including a plurality of fasteners connecting said independent suspension sheet to said eave struts.

11. The system for thermally insulating a roof structure with fall protection of claim 10 wherein said plurality of band fasteners connecting said transverse bands to the underside of said purlins comprise-headed fasteners with washers.

12. The system for thermally insulating a roof structure with fall protection of claim 11 wherein said plurality of band fasteners connecting said transverse bands to the underside of said purlins comprise self-drilling self-tapping fasteners with washers.

13. The system of thermally insulating a roof structure with fall protection of claim 1 wherein at least some of the transverse support bands are interwoven over at least one of the longitudinal support bands and under at least one of the other of the longitudinal support bands.

14. A method of installing insulation and providing fall protection in a building roof structure including a pair of rafters having opposite ends, a pair of eave struts connected to and extended between opposite ends of said rafters, and a plurality of intermediate purlins extending longitudinally between said pair of rafters, comprising the steps of, providing a plurality of longitudinal and transverse support bands of sufficient strength to support at least approximately 400 pounds, extending a plurality of longitudinal support bands between said pair of rafters, said plurality of longitudinal support bands having opposite ends overlapping each of said rafters, fastening each end of said rafters with a pair of spaced apart fasteners including inner and outer fasteners and spacing said outer fastener at least two inches from an adjacent end of said longitudinal support band, extending a plurality of transverse support bands between said pair of eave struts, said transverse support bands having opposite ends extending beyond said eave struts, fastening each end of said transverse support bands respectively to said eave struts with a pair of spaced apart fasteners including inner and outer fasteners and spacing said outer fastener at least two inches from an adjacent end of said transverse support band, providing a continuous independent suspension sheet having a length longer than the distance between said rafters so as to extend beyond said rafters and a width greater than the distance between said eave struts so as to extend beyond said eave struts, said suspension sheet being of sufficient strength to support at least approximately 400 pounds, spreading out said suspension sheet on said longitudinal and transverse support bands, and securing said transverse support bands to the underside of said purlins and eave struts with said suspension sheet therebetween by inserting said band fasteners therethrough at spaced intervals along each transverse support band.

15. The method of installing insulation and providing fall protection of claim 14 wherein securing said transverse bands to the underside of said purlin by inserting band fasteners through said transverse band comprises arranging said band fasteners at a maximum spacing of thirty inches on center along the underside of said purlins and eave struts.

16. The method of installing insulation and providing fall protection of claim 14 wherein the step of fastening each end of said longitudinal support bands to said rafters includes fastening support bands to one of said rafters, pulling the longitudinal support band tight to the opposite rafter and marking two hole locations on the longitudinal support band a minimum of two inches apart and punching the two marked holes in the longitudinal support band, pulling the longitudinal support band tight and marking an outer hole on the rafter, pre-drilling a first hole through the rafter approximately one-half inch beyond the marked outer hole, pre-drilling a second hole in the rafter a minimum of two inches inwardly from the pre-drilled first hole, installing a fastener completely through the outer hole of the longitudinal support band, angling the fastener tip into the pre-drilled first hole and screwing in the fastener into the rafter to tension the longitudinal support band, and installing the second fastener through the second and inner holes in the longitudinal support band and rafter, respectively.

17. The method of installing insulation and providing fall protection of claim 14 further comprising sealing the edges of said independent support sheet to said rafters.

18. The method of installing insulation and providing fall protection of claim 14 further comprising clamping said suspension sheet to said eave strut and rafters prior to securing said transverse support bands to the underside of said purlins and eave struts with said suspension sheet therebetween.

* * * * *